US006306040B1

(12) United States Patent
Chang

(10) Patent No.: US 6,306,040 B1
(45) Date of Patent: Oct. 23, 2001

(54) TELESCOPIC BATON

(76) Inventor: Kuo Chi Chang, No. 8, Lane 184, Sung Chiang Rd., Taipei (TW)

( * ) Notice: Subject to any disclaimer, the term of this patent is extended or adjusted under 35 U.S.C. 154(b) by 0 days.

(21) Appl. No.: 09/589,767

(22) Filed: Jun. 9, 2000

(51) Int. Cl.[7] ..... F41B 15/02
(52) U.S. Cl. ..... 463/47.7
(58) Field of Search ..... 463/47.2, 47.7; 135/75; D21/100, 117

(56) References Cited

U.S. PATENT DOCUMENTS 4,037,839 * 7/1977 Nelson .
5,356,139 * 10/1994 Parsons .

* cited by examiner

*Primary Examiner*—William M. Pierce
(74) *Attorney, Agent, or Firm*—Dougherty & Troxell

(57) ABSTRACT

A telescopic baton having an elastic multi-claw retaining means for holding a telescoped shaft of the baton in place is provided. The baton includes a handle, a middle shaft adapted to slide into the handle, a front shaft adapted to slide into the middle shaft, and a fixing cap screwed to a rear open end of the handle. The multi-claw retaining means is punched into the fixing cap by a suitable means to firmly adhere to an inner rear end of the fixing cap. The claws of the elastic retaining means extend forward and are bent into predetermined shape to elastically and frictionally grip a rear end of the front shaft from different radial directions when the front and the middle shafts are fully telescoped into the handle.

3 Claims, 5 Drawing Sheets

FIG1 PRIDR ART

TELESCOPIC BATON

BACKGROUND OF THE INVENTION

The present invention relates to a telescopic baton, and more particularly to a telescopic baton having an easily mountable elastic multi-claw retaining means for effectively holding a fully telescoped shaft of the baton in place. The retaining means enables the telescopic baton to be assembled at reduced time and labor cost, and the shaft of the baton to be more stably held in a fully telescoped position.

FIG. 1 illustrates a conventional telescopic baton that mainly includes a hollow handle 1, a shaft 2 adapted to slide into the handle 1, and a fixing cap 3 screwed to a rear open end of the handle 1. An elastic plate is bent into an elastic closed loop 31 and then fixed with a rivet or screw 32 to a front end of the fixing cap 3. An inner diameter 21 of a rear end portion of the shaft 2 gradually increases rearward so that the shaft 2 has a flared inner wall 22 at the rear end portion. When the shaft 2 is fully telescoped into the handle 1, the flared inner wall 22 of the rear end of the shaft 2 would fitly engage with an outer periphery of the elastic closed loop 31 and be held in place in the handle 1. To extend the shaft 2 from the handle 1, simply hold and forcefully swing the handle 1. At this point, the shaft 2, due to its own weight, would disengage from the elastic closed loop 31 to slide out of the handle 1. The following are some disadvantages of the telescopic baton of FIG. 1:

1. Since the elastic plate is in the form of a closed loop, it is uneasy to align the rivet or screw 32 with a hole 33 provided at a front end surface of the fixing cap 3 to fix the elastic closed loop 31 to the fixing cap 3. More efforts and time are needed to complete the assembling of the elastic closed loop 31 to the fixing cap 3 to increase the manufacturing cost of the telescopic baton.
2. The elastic closed loop 31 fixed to the fixing cap 3 projects forward from the fixing cap 3 and makes it more difficult to screw or loosen the fixing cap 3 onto or from the rear end of the handle 1. The elastic closed loop 31 is easily subject to deformation due to unexpected falling and/or collision with some other articles before the fixing cap 3 has been mounted into the rear end of the handle 1. And a deformed elastic closed loop 31 is not easily aligned with and extended into the rear end of the shaft 2 to firmly hold the shaft 2 in a telescoped position.
3. The elastic closed loop 31 has a curved and smooth outer periphery and there are only two contact points between the elastic closed loop 31 and the inner diameter 21 of the shaft 2 when the shaft 2 engages with the loop 31, therefore, the shaft 2 could not be stably and firmly held in the handle 1 by the elastic closed loop 31. The shaft 2 in the telescoped position tends to unexpectedly slide out of the handle 1.

It is therefore tried by the inventor to develop an improved telescopic baton having a multi-claw retaining means that can effectively hold a shaft of the baton in a fully telescoped position and be easily and safely mounted in an inner space defined by a fixing cap of the baton.

SUMMARY OF THE INVENTION

A primary object of the present invention is to provide a telescopic baton having an elastic multi-claw retaining means for effectively holding a shaft of the baton in a fully telescoped position. The elastic multi-claw retaining means may be easily punched into a cylindrical fixing cap of the baton by a suitable means. No efforts are needed to align any fastening means with any fixing hole to mount the elastic multi-claw retaining means into the fixing cap. The telescopic baton can therefore be more easily assembled at reduced time and labor cost.

Another object of the present invention is to provide a telescopic baton having an elastic multi-claw retaining means that firmly and evenly grips a shaft of the baton fully telescoped into a hollow handle of the baton from more than two different radial directions, so that the telescoped shaft is not easily separated from the claws of the retaining means to slide out of the handle of the baton.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
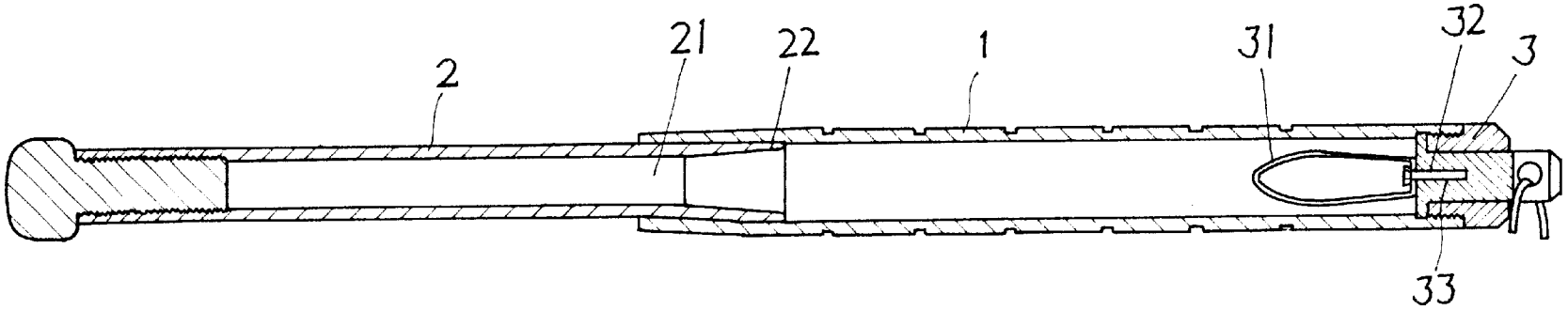
FIG. 1 is an assembled sectional view of a conventional telescopic baton in a fully extended state.
Figure 2:
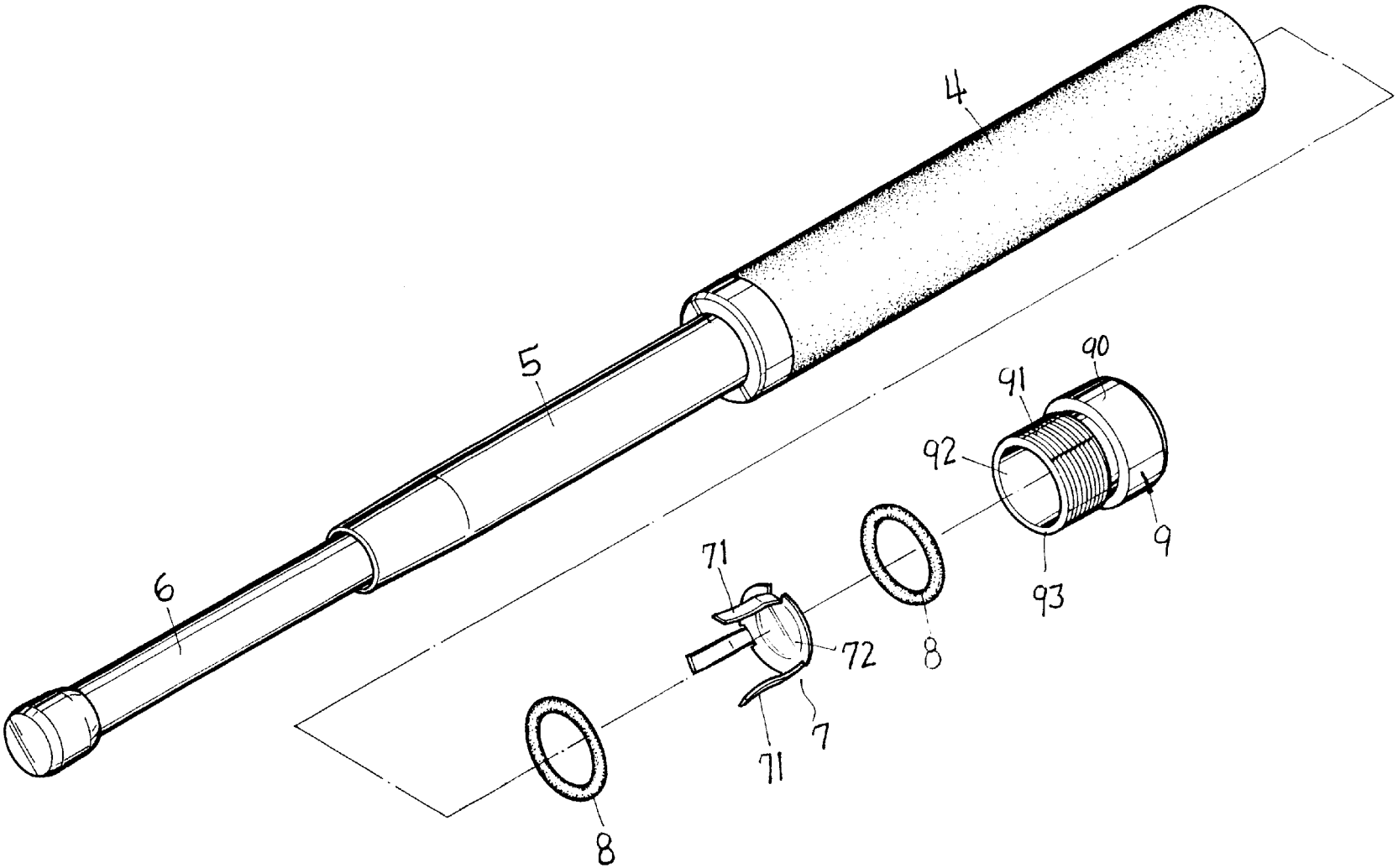
FIG. 2 is an exploded perspective of a telescopic baton according to the present invention in a fully extended state.
Figure 3:
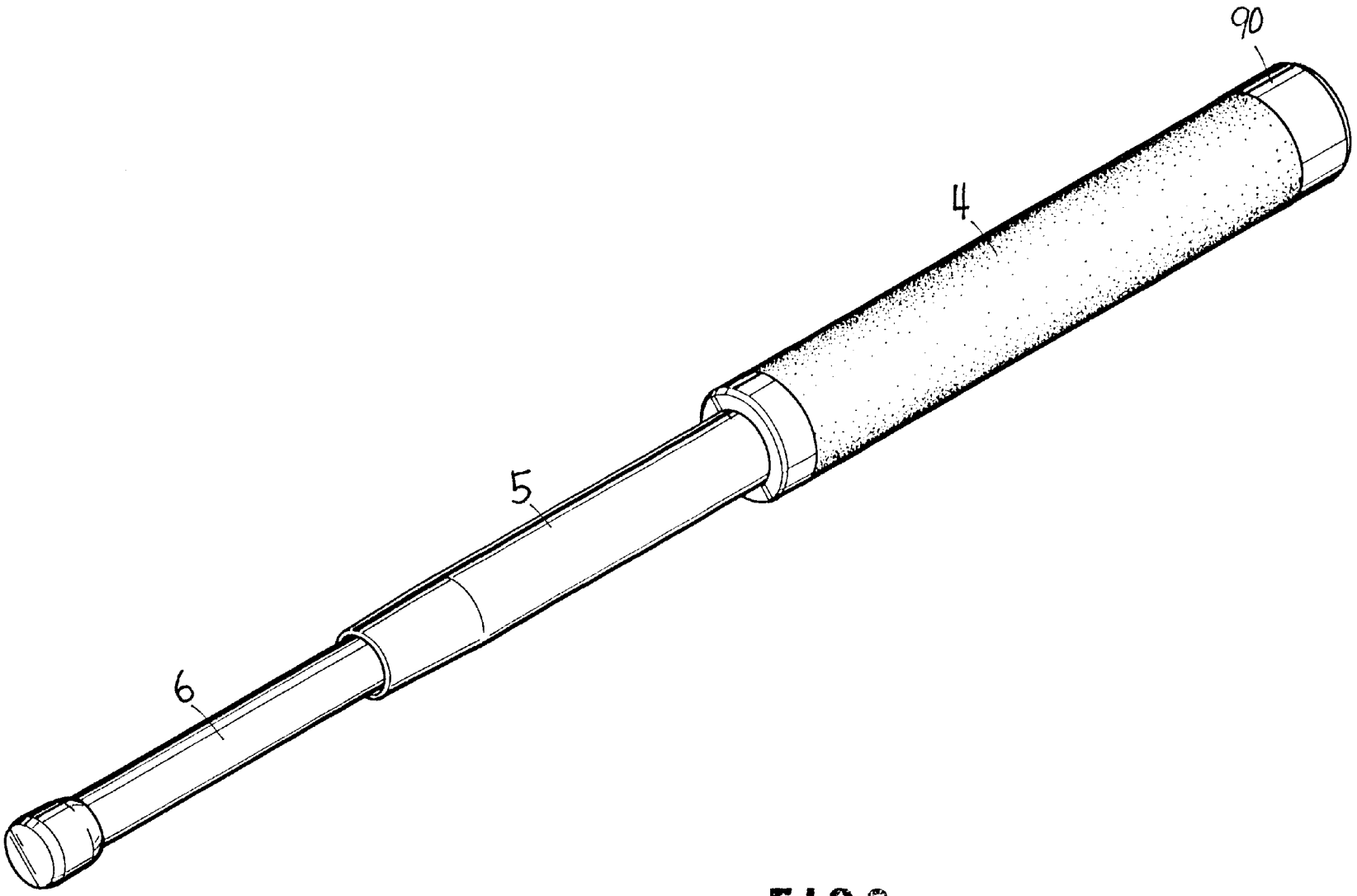
FIG. 3 is an assembled perspective of the telescopic baton of FIG. 2.

Please refer to FIGS. 2 and 3 that are exploded and assembled perspective views, respectively, of a telescopic baton according to the present invention in a fully extended state. As shown, the telescopic baton mainly includes a handle 4, a middle shaft 5 adapted to slide into the handle 4, a front shaft 6 adapted to slide into the middle shaft 5, and a retaining means for retaining the front shaft 6 in a telescoped position in the handle 4. The retaining means mainly includes a multi-claw elastic retainer 7, two washers 8, and a fixing cap 9.

Figure 4:
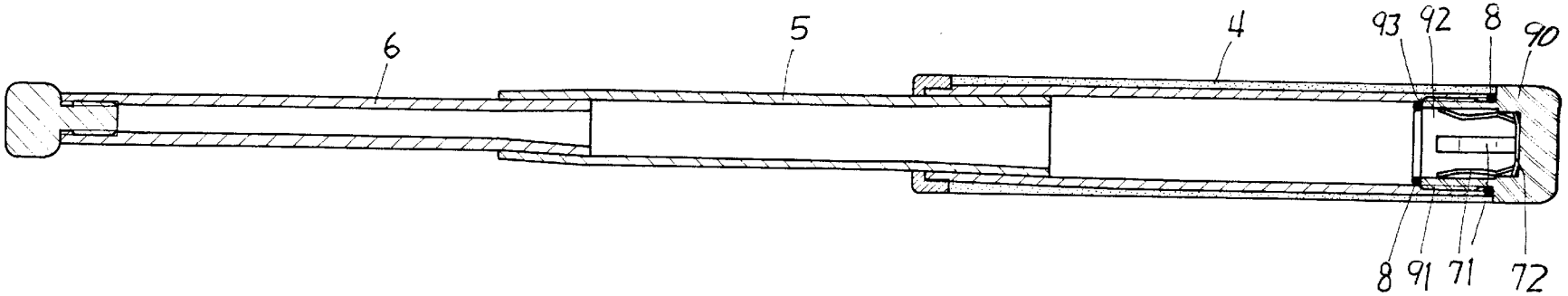
FIG. 4 is an assembled sectional view of the telescopic baton of FIG. 2 in a fully extended state.

Please refer to FIGS. 2 and 4 at the same time. The fixing cap 9 is a cylindrical hollow member having a closed rear portion and a front portion 90 provided with an external thread 91 for the fixing cap 9 to screw into a rear open end of the handle 4. The fixing cap 9 defines an inner space 92 in which the multi-claw elastic retainer 7 is received.

One of the two washers 8 is disposed around the front portion 90 of the fixing cap 9 close to an inner end of the external thread 91. The other washer 8 is disposed in the handle 4 immediately in front of a front end 93 of the fixing cap 9.

Figure 5:
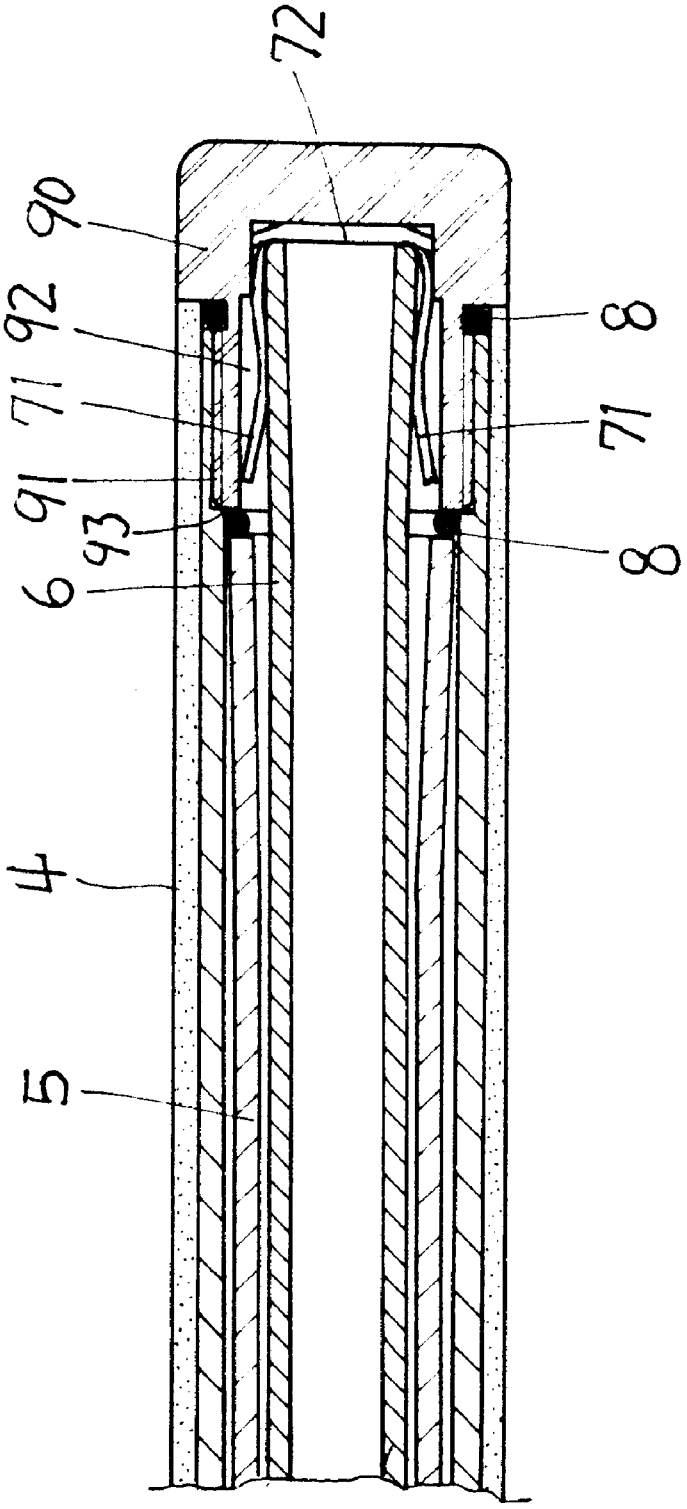
FIG. 5 is a fragmentary, enlarged and assembled sectional view of the telescopic baton of the present invention in a fully telescoped state to show the manner of retaining a front shaft telescoped in a handle of the baton by a multi-claw retaining means.

The multi-claw elastic retainer 7 includes multiple, preferable more than two, elastic claws 71 perpendicularly and equally space along an outer periphery of a flat disc 72. Each of the claws 71 is so bent that a free end portion of the claw 71 extends radially outward and a small portion of the claw 71 behind the free end portion curves radially inward. An inner diameter of an imaginal circle defined by the radially outward extended free ends of the multiple claws 71 is slightly larger than an outer diameter of a rear end of the front shaft 6, and an inner diameter of an imaginal circle defined by the radially inward curved portions of the claws 71 is slightly smaller than the outer diameter of the rear end of the front shaft 6. By applying a suitable type of adhesive on a back surface of the flat disc 72 opposite to the claws 71 and then punching the retainer 7 at a front surface of the disc 72 with a suitable means, the retainer 7 is moved into the inner space defined by the fixing cap 9 with the adhesive-applied back surface of the disc 72 punched into and firmly adhered to the closed rear portion of the fixing cap 9, as shown in FIGS. 4 and 5.

The rear end of the front shaft 6 is diametrically gradually expanded to have a flared profile. As mentioned above, this flared rear end of the front shaft 6 has an outer diameter slightly smaller than the inner diameter of the radially outward extended front end portion of the elastic claws 71 of the retainer 7 and slightly larger than the inner diameter of the radially inward curved portion of the elastic claws 71. Whereby, when the telescopic baton of the present invention is in a fully telescoped state with the front shaft 6 telescoped into the middle shaft 5 and the latter telescoped into the handle 4, as shown in FIG. 5, the flared rear end of the front shaft 6 rearward extends through the radially outward extended front end portions of the claws 71 to abut against the inner side of the flat disc 72. At this point, an outer peripheral surface of the flared rear end portion of the front shaft 6 also frictionally and firmly contacts with the radially inward curved portions of the claws 71, enabling the multiple elastic claws 71 to grip the telescoped front shaft 6 at the flared rear end thereof from more than two different directions and therefore effectively prevent the telescoped front shaft 6 from easily sliding out of the middle shaft 5 and the handle 4.

What is claimed is:

1. A telescopic baton comprising a handle having an open forward end and an inward threaded rear end, a middle shaft adapted to slide into said handle through said open forward end, a front shaft having a smooth outer surface along its length adapted to slide into said middle shaft and a fixing cap, said fixing cap defining a cylindrical hollow member having a closed rear portion and a threaded front portion provided with an external thread for screwing into said open inward threaded rear end of said handle, said fixing cap defining an open inner space, and an elastic retaining means including a solid flat disk and four elastic claws equally spaced around the periphery of said flat disk and extending forwardly from the rear end of said handle and said flat disk being adhesively bonded to said closed rear portion of said fixing cap and said elastic retaining means including said four elastic claws adapted to engage a rear portion of said front shaft when the telescopic baton is in a closed position.

2. A telescopic baton as claimed in claim 1, wherein each of said elastic claws of said elastic retaining means is so bent that a free end portion of said claw extends radially outward and a small portion of said claw behind said free end portion curves radially inward, such that an inner diameter of an imaginal circle defined by said radially outward extended free end portions of said multiple claws is slightly larger than an outer diameter of said rear end of said front shaft, and an inner diameter of an imaginal circle defined by said radially inward curved portions of said claws is slightly smaller than the outer diameter of said rear end of said front shaft.

3. A telescopic baton as claimed in claim 1, wherein said rear end of said front shaft is diametrically gradually expanded to have a flared profile, and said flared rear end of said front shaft having a largest outer diameter slightly larger than an inner diameter defined by said radially inward curved portions of said elastic claws.

* * * * *